United States Patent [19]

Looper

[11] Patent Number: 4,634,070

[45] Date of Patent: Jan. 6, 1987

[54] APPARATUS AND METHOD FOR MEASURING AND PACKAGING ELASTIC PRODUCTS

[76] Inventor: Ernest F. Looper, Rte. 9, Box 254, Easley, S.C. 29640

[21] Appl. No.: 588,990

[22] Filed: Mar. 13, 1984

[51] Int. Cl.[4] ..... B65H 18/14; B65H 23/198

[52] U.S. Cl. ..... 242/67.2; 242/75.52; 242/DIG. 2

[58] Field of Search ..... 242/67.1 R, 75.51, 75.52, 242/75.5, 184, 67.2; 33/132 R, 132 A, 136

[56] References Cited

U.S. PATENT DOCUMENTS

| | | | |
|---|---|---|---|
| 2,869,241 | 1/1959 | Witt | 33/132 |
| 3,177,749 | 4/1965 | Best et al. | 242/75.51 X |
| 3,755,861 | 9/1973 | Castro | 242/75.52 X |
| 4,195,791 | 4/1980 | Frazee, Jr. | 242/75.52 X |
| 4,437,619 | 3/1984 | Cary et al. | 242/75.51 |
| 4,447,016 | 5/1984 | Enberg et al. | 242/75.52 X |

FOREIGN PATENT DOCUMENTS

| | | | |
|---|---|---|---|
| 129502 | 1/1978 | German Democratic Rep. | 242/67.1 |

*Primary Examiner*—John M. Jillions
*Attorney, Agent, or Firm*—Bailey & Hardaway

[57] ABSTRACT

An apparatus and method is illustrated for measuring and packaging elongated elastic material such as elastic narrow fabric or tape, lace and the like, wherein a controlled loop of material is fed across a free turning, low inertia measuring wheel and the like, just prior to being wound into a package.

3 Claims, 5 Drawing Figures

APPARATUS AND METHOD FOR MEASURING AND PACKAGING ELASTIC PRODUCTS

BACKGROUND OF THE INVENTION

Winding and spooling devices for extensible materials have presented a problem in packaging a predetermined or accurately measured length of material on the package. The tension required to produce a good package often causes the material to be stretched and therefore distorts the measurements of length. Some elastic products, and for example lace fabrics in particular, are very expensive, and accurate measurement of the material on each package is most desirable.

The present invention aids in winding by feeding the extensible materials and winding them with a minimum amount of tension. This is accomplished by the use of a controlled loop of material being fed across a low inertia measuring device just prior to being wound onto a package. A photocell or other means is used to monitor the position of the material in the loop and control the speed of the winding device to maintain a tension-free package.

Accordingly, it is an important object of this invention to provide apparatus for winding elongated elastic material wherein the elastic fabric and the like is fed in a substantially tensionless state in a winder.

Another important object of this invention is to package elastic fabric and the like upon a winder in such a way that a cosmetically acceptable package is formed without stretching of the material and so that the material is wound and configured in the package in a substantially tensionless state.

Another important object of this invention is to accurately measure a length of elastic material without imparting tension to it in such a way that a more acceptable package may be formed and wherein the correct amount of product may be measured and applied to a given package.

Another important object of this invention is to provide automatic braking for use with the low inertia measuring device to avoid inaccuracies.

Still another important object of this invention is the provision of an adjustable traversing device to allow the winder to be used either as a blocker or as a spooling machine for narrow fabrics to provide a variety of packages.

The prior art includes loop control mechanism of the type illustrated in U.S. Pat. Nos: 2,108,410, 2,379,132, and 3,550,828.

SUMMARY OF THE INVENTION

It has been found that elastic fabric may be packaged by feeding a loop of material across a low inertia measuring device just prior to being wound into a package. A suitable signaling means such as a photo electric cell is utilized to monitor the position of the loop and control the speed of the winding device to maintain a tension-free package. It is desired to provide an automatic braking device for the low inertia measuring wheel and to provide a surface inclined to the normal in such a way as to afford support for stabilizing the loop and to possibly reduce tension in the fabric being fed to the measuring wheel.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate apparatus for measuring and packaging elongated elastic material having a free turning, low inertia measuring wheel A. Means B including feed rolls are provided for feeding a depending loop of suspended or hanging elongated elastic material to the measuring wheel. Means C are operable responsive to the size of the loop controlling means for taking up the loop of elongated elastic material or feed means as desired. A winder D receives the elongated elastic material in a substantially tensionless state from the measuring wheel. The loop is supported in a substantially tension free state between the feed rolls and the measuring wheel. Means E supports or guides the said elastic material in its passage from the measuring wheel to the winder. An automatic braking apparatus F for stopping feeding of the elongated elastic material by said measuring wheel is actuated responsive to a cessation of winding of the elongated elastic material to form a package. A pivoted surface G is included to provide stability to the loop enabling the photo cell C to have a more reliable signal.

Figure 3:
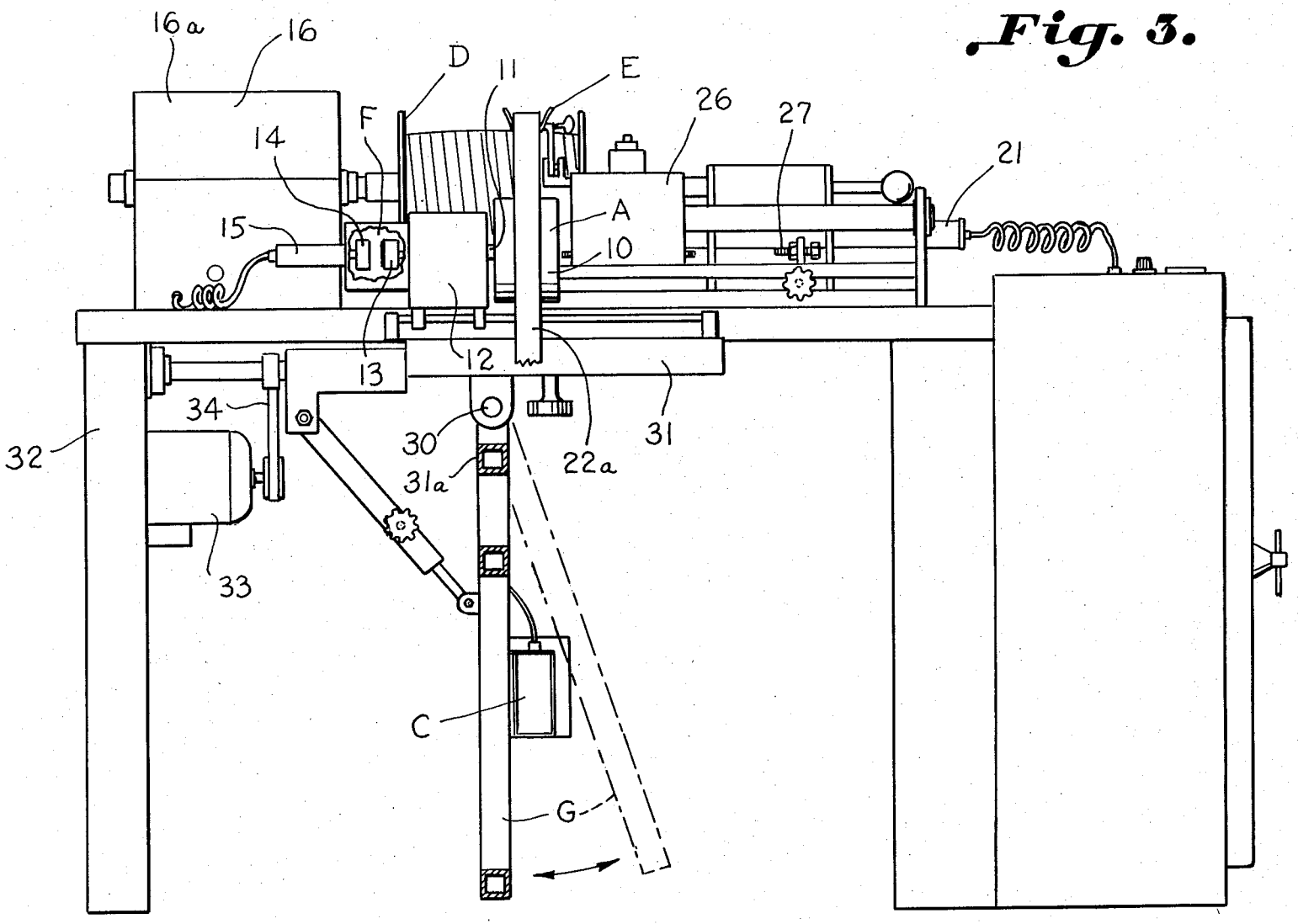
FIG. 3 is a front elevation further illustrating the apparatus of FIGS. 1 and 2 taken on the line 3—3 in FIG. 1.

The low inertia measuring wheel includes a hollow drum 10 carried by a shaft 11 which turns to actuate the counting mechanism 12. The braking apparatus F includes a housing containing braking members 13 and 14. The shaft has a braking member 13 carried thereon (FIG. 3). A braking member 14 is provided for actuation by a cylinder 15 responsive to cessation of the drive mechanism 16 The light source C operates to cause cessation of the drive mechanism 16 through control of the power supply therefor as described below in connection with FIG. 5 contained in the housing 16*a*. The drive mechanism includes a power takeoff shaft 17 which extends from driving means contained within the housing 16*a*. The power takeoff shaft 17 drives a chuck 18 which in turn drives the spool 19 which is removably supported by a block 20 which is moved in and out in response to the cylinder 21 for response to accommodate the various size spools operated as a part of the winder D or to operate as a blocker.

Figure 1:
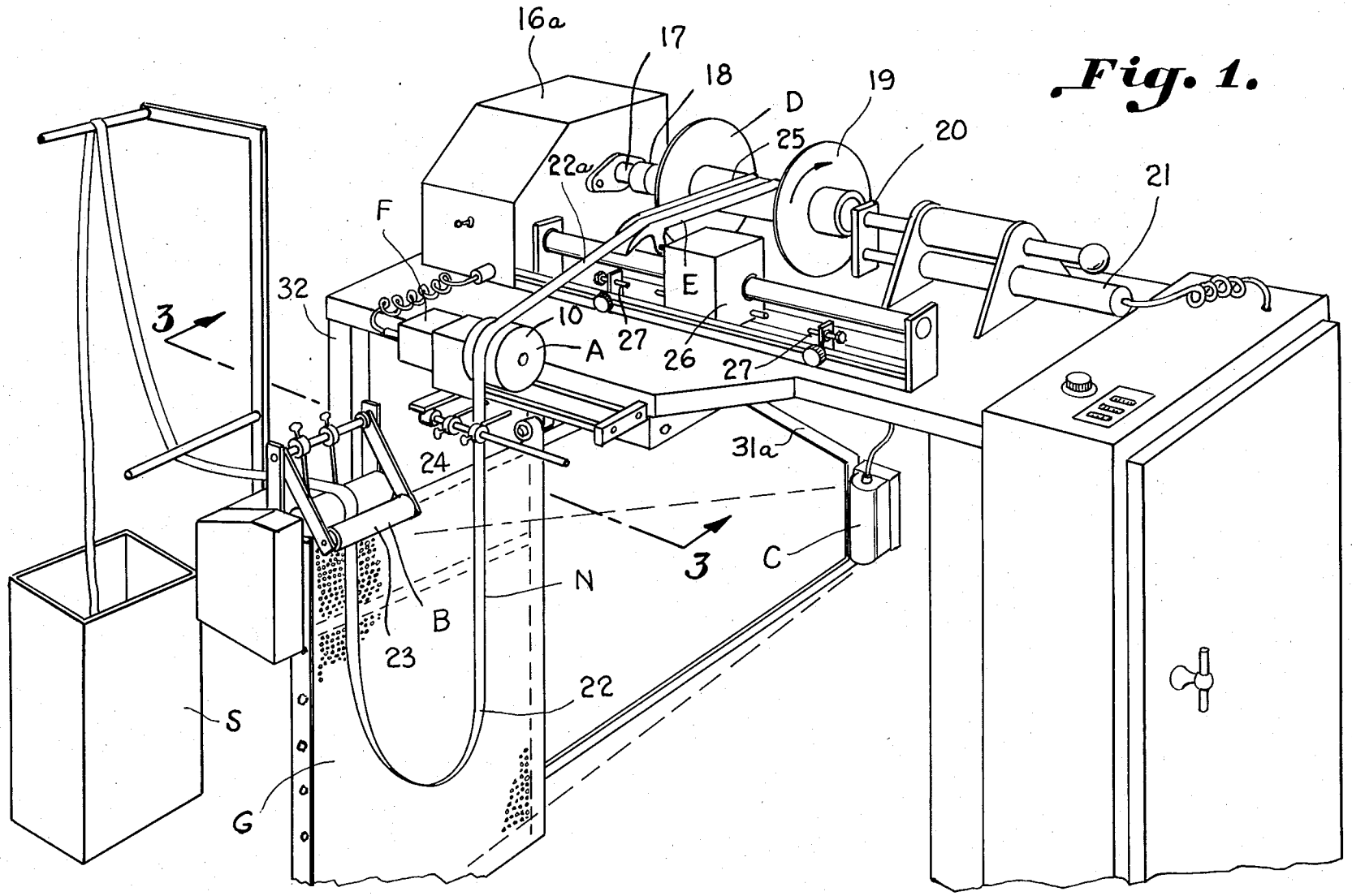
FIG. 1 is a perspective view illustrating the method and apparatus for measuring and packaging elongated elastic material constructed in accordance with the present invention.
Figure 2:
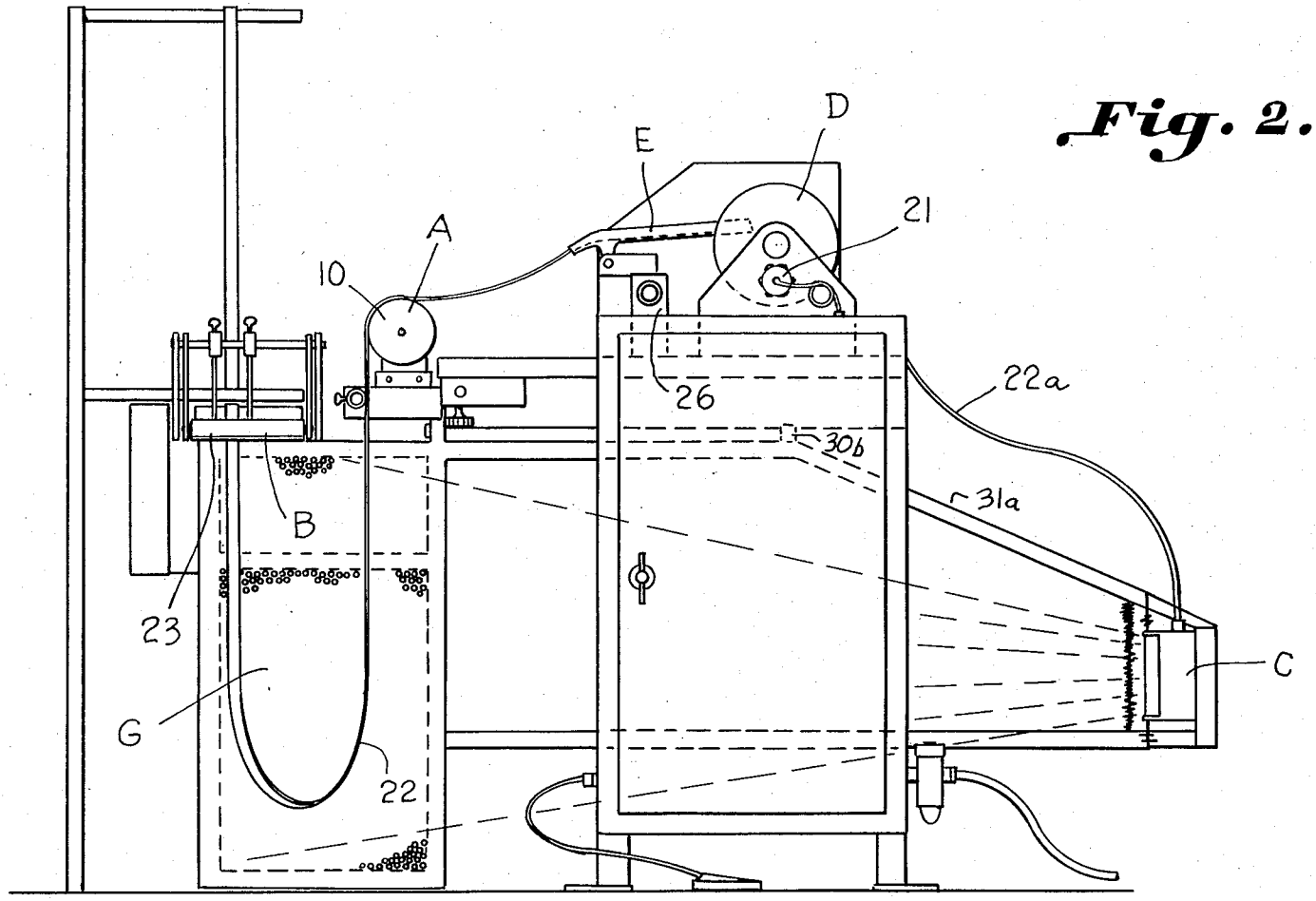
FIG. 2 is a side elevation looking toward the right-hand side of FIG. 1 further illustrating the apparatus and method.

Referring more particularly to FIGS. 1 and 2, the loop 22 is illustrated as being fed from a supply S by means B including the rolls 23 and 24 which are driven by a variable speed motor. In order to ensure that the narrow fabric 22*a* is properly fed, an oscillating guide 25 supports the narrow fabric for winding along the length of the spool by the winder D. The guide or support 25 is carried by the housing 26 for oscillation between adjustable limit switch elements 27 depending on whether or not the winder is used as a blocker or to build a spool by traverse of the support 25 as permitted between the limit switches 27.

It will be noted that a foraminous surface G, which may be constructed of expanded metal, may be pivoted as at 30 upon a suitable support 31 which is in turn carried by the frame 32. The frame 32 carries the feed roll motor 33 which through the belt 34 drives the feed rolls B. The expanded metal serves as a part of a pivoted frame having an extension 31*a* for carrying the photo cell C.

Figure 4:
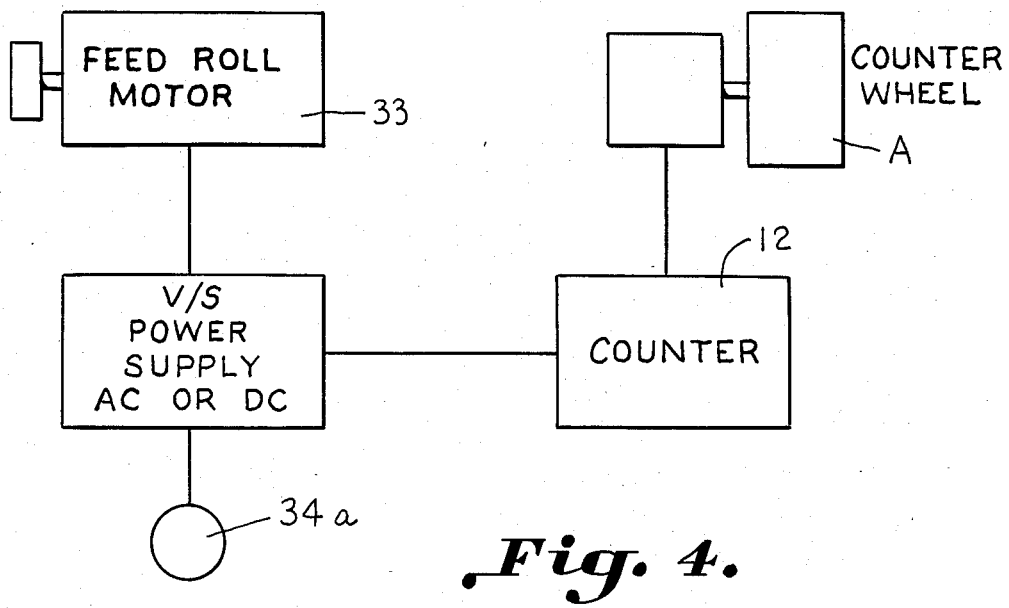
FIG. 4 is a block diagram illustrating various operating mechanism directed to the feeding and measuring apparatus.
Figure 5:
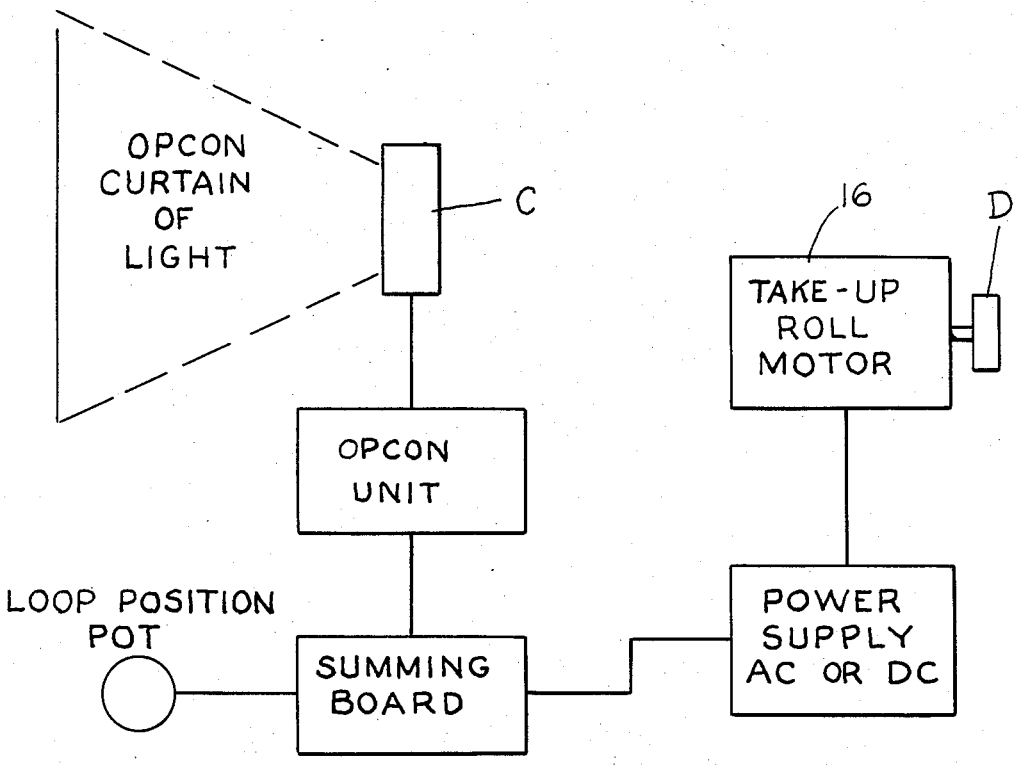
FIG. 5 is a block diagram illustrating the operating mechanism for the winding apparatus responsive to the position of the loop of elastic fabric.

FIG. 4 illustrates the power supply for the feed roll motor 33 which operates responsive to the manually adjustable potentiometer 34*a*. Adjustment of the potentiometer determines the point at which the feed roll motor ceases to operate to feed the fabric. The power supply is deactivated by the counter 12 responsive to rotation of the wheel A upon completion of the winding of a predetermined length of material on the package. FIG. 5 illustrates the light source C and unit which operates to control the power supply for the takeup roll motor 16 of the winder D.

Thus, the means E supports the elastic material in its passage from the measuring wheel to the winder to ensure that the elongated elastic material moves to the winder in a substantially tensionless state. Further, the formanious surface G is generally aligned with a delivery path for the elastic material between the feeding means and measuring wheel stabilizing the loop and providing a more reliable signal to the system during the material's passage to the measuring wheel. The frame and pivoted frame extension 31*a* carried thereby is pivoted so as to move the surface G and the sensing means C, mounted on the frame and extension respectively together to maintain alignment. Since the loop passes on the surface G when the frame is properly tilted the sensing means is in proper alignment therewith. The surface, if desired, may be solid rather than formanous and may serve to eliminate air pressure or disturbance and avoids static electricity. The support is adjustable by varying the tilt or inclination of the surface about the pivot points 30*a* and 30*b*. By maintaining the loop tensionless operation is assured since the winder motor is controlled responsive thereto, and since the counter mechanism, which operates independently thereof, has a low inertia measuring wheel receiving fabric from the loop. The speed of the feed roll motor is controlled by the manually adjustable potentiometer.

While a preferred embodiment of the invention has been described using specific terms, such description is for illustrative purposes only and it is to be understood that changes and variations may be made without departing from the spirit or scope of the following claims.

What is claimed is:

1. Apparatus for measuring and packaging elongated elastic material comprising:

a free turning, low inertia measuring wheel;

means feeding said elongated elastic material forming a suspended loop of said elongated elastic material between said means feeding and said measuring wheel;

a winder receiving elongated elastic material from said loop in a substantially tensionless state from said measuring wheel;

said loop being suspended between said feed means and said measuring wheel; and means operable responsive to sensing the size of said loop controlling the winder and hence the sizes of said loop of elongated elastic material;

a surface generally aligned with a delivery path of said elastic material between said feeding means and measuring wheel stabilizing the position of the loop during its passage to said measuring wheel, and a frame pivoted about a horizontal transverse axis carrying said aligned surface and carrying sensing means operable responsive to the size of the loop for controlling said winder for limiting the size of the loop.

2. The structure set forth in claim 1 including a brake actuated responsive to cessation of winding for positively stopping said measuring wheel.

3. The method of measuring and packaging elongated elastic material comprising the steps of:

feeding said elongated elastic material forming a loop of said elongated elastic material to a free turning, low inertia measuring wheel;

controlling the size of said loop of elongated elastic material responsive to sensing the size of said loop; and suspending said loop of said elongated elastic material by gravity between said measuring wheel and a feeding apparatus which delivers said elongated elastic material forming a loop to the measuring wheel and winding said elongated elastic material received from said measuring wheel in a substantially tensionless state providing a surface generally aligned with a delivery path of said elastic material between said feeding apparatus and measuring wheel stabilizing the position of the loop during its passage to said measuring wheel, and providing a frame pivoted about a horizontal transverse axis carrying said aligned surface and carrying sensing means responsive to the size of the loop for controlling said winding for limiting the size of the loop.

* * * * *